US008401454B2

(12) United States Patent
Pitas et al.

(10) Patent No.: US 8,401,454 B2
(45) **Date of Patent: *Mar. 19, 2013**

(54) SYSTEM FOR COLLECTING WASTE TONER

(75) Inventors: Jeffrey A. Pitas, Macedon, NY (US); Francisco L. Ziegelmuller, Penfield, NY (US); Kevin H. Blakely, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 337 days.

This patent is subject to a terminal disclaimer.

(21) Appl. No.: 12/885,627

(22) Filed: Sep. 20, 2010

(65) Prior Publication Data

US 2012/0070209 A1 Mar. 22, 2012

(51) Int. Cl.
*G03G 21/00* (2006.01)
*G03G 21/10* (2006.01)

(52) U.S. Cl. ..... 399/358; 399/360

(58) Field of Classification Search ..... 399/358, 399/360, 261, 258
See application file for complete search history.

(56) References Cited

U.S. PATENT DOCUMENTS

| | | | | |
|---|---|---|---|---|
| 6,266,511 | B1 * | 7/2001 | Murakami et al. | 399/358 |
| 6,493,528 | B2 * | 12/2002 | Sameshima et al. | 399/360 X |
| 2005/0002708 | A1 * | 1/2005 | Jeong et al. | 399/358 |
| 2008/0118290 | A1 * | 5/2008 | Sato | 399/358 |
| 2009/0154972 | A1 * | 6/2009 | Tanaka et al. | 399/358 |
| 2012/0070210 | A1 * | 3/2012 | Pitas et al. | 399/358 |

* cited by examiner

*Primary Examiner* — Sophia S Chen
(74) *Attorney, Agent, or Firm* — Nelson Adrian Blish

(57) ABSTRACT

A system for collecting waste toner or developer in an electrophotographic printer includes a waste collection tube for collecting waste toner or developer in an electrophotographic module. An auger transports waste toner or developer from the collection tube through a transport tube to a waste container. A spring has a first end in the collection tube and a second end fixed within the transport tube of the auger. An elbow of the spring rides on the auger and the motion of the auger causes the spring to oscillate in the collection tube.

5 Claims, 3 Drawing Sheets

SYSTEM FOR COLLECTING WASTE TONER

CROSS REFERENCE TO RELATED APPLICATIONS

Reference is made to commonly-assigned copending U.S. patent application Ser. No. 12/885,635 (now U.S. Publication No. 2012/0070210) filed Sep. 20, 2010, entitled A METHOD FOR COLLECTING WASTE TONER, by Pitas et al.; the disclosure of which is incorporated herein.

FIELD OF THE INVENTION

This invention relates in general to an electrophotographic printer and in particular to collecting waste toner and developer in the electrophotographic printer.

BACKGROUND OF THE INVENTION

The electrophotographic process creates an image on paper or other suitable printing media. The primary material used for printing purposes is toner. During the printing process not all of the toner transfers to the print media. Some of this toner may be unsuitable for transfer, but is present in the toner supply, or some of the toner may be intended to be discarded as part of the normal process.

When this residual material is produced it is necessary to transport the material to a collection point. The material is often tacky, does not transport well, even if aided by mechanical auger devices. Further it is often difficult to ensure all paths from the waste creation points to the transport devices remain clear. Areas with passive transport aid, such as using gravity only, often require manual intervention to prevent clogging. Therefore a means of clogging prevention is needed for these passive paths.

SUMMARY OF THE INVENTION

Briefly, according to one aspect of the present invention a system for collecting waste toner or developer in an electrophotographic printer includes a waste collection tube for collecting waste toner or developer in an electrophotographic module. An auger transports waste toner or developer from the collection tube through a transport tube to a waste container. A spring has a first end in the collection tube and a second end fixed within the transport tube of the auger. An elbow of the spring rides on the auger and the motion of the auger causes the spring to oscillate in the collection tube.

The invention and its objects and advantages will become more apparent in the detailed description of the preferred embodiment presented below.

DETAILED DESCRIPTION OF THE INVENTION

The present invention will be directed in particular to elements forming part of or in cooperation more directly with the apparatus in accordance with the present invention. It is to be understood that elements not specifically shown or described may take various forms well known to those skilled in the art.

Figure 1:
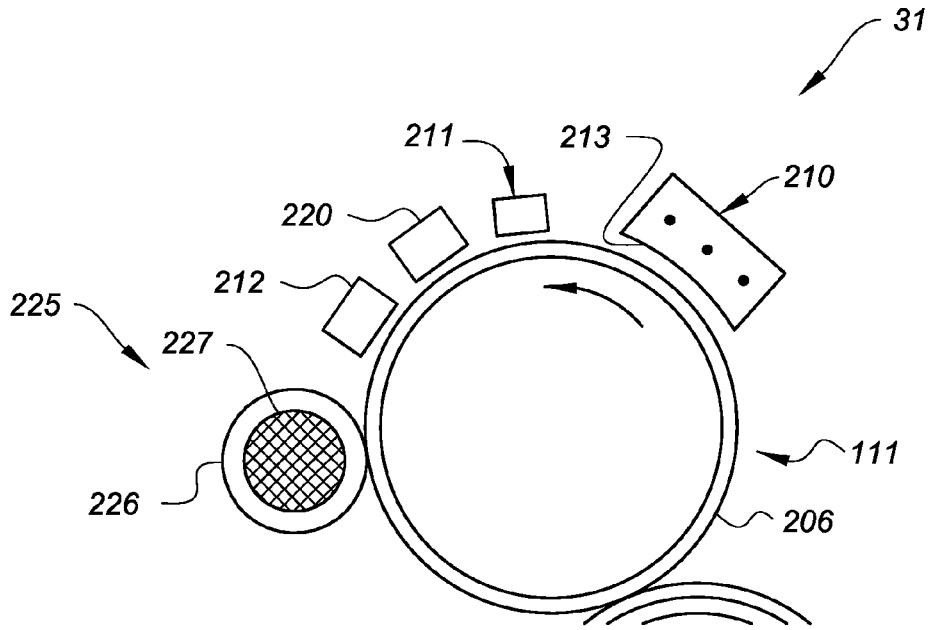
FIG. 1 is a cross-section of an electrophotographic print module.

Referring now to FIG. 1, an electrophotographic printer includes components necessary to print an image on paper. A printer is comprised of various sub-assemblies which perform specific functions.

An imaging module 31, shown in FIG. 1 in the printer consists of components to enable printing of a single color image. Multiple modules may be assembled to enable the printing of multiple color images. FIG. 1 shows details of a typical imaging module 31, which may be assembled with other imaging modules to enable printing multiple colors.

Primary charging subsystem 210 uniformly electrostatically charges photoreceptor 206 of photoreceptive member 111, shown in the form of an imaging cylinder. Charging subsystem 210 may include a grid 213 having a selected voltage, or may be in the form of a roller with conductive properties.

Additional necessary components provided for control may be assembled around the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206.

Image writer 220 is used to expose photoreceptor 206 and may be a light emitting diode (LED) array or other similar mechanisms or laser. Toning unit 225, comprising elements 226 and 227 is used to develop the latent image created by writer 220 on photoreceptor 206. Cleaning unit 230 removes residual toner from photoreceptor 206 after transfer of the image to a secondary receiver. Other meters and components may be included.

Figure 2:
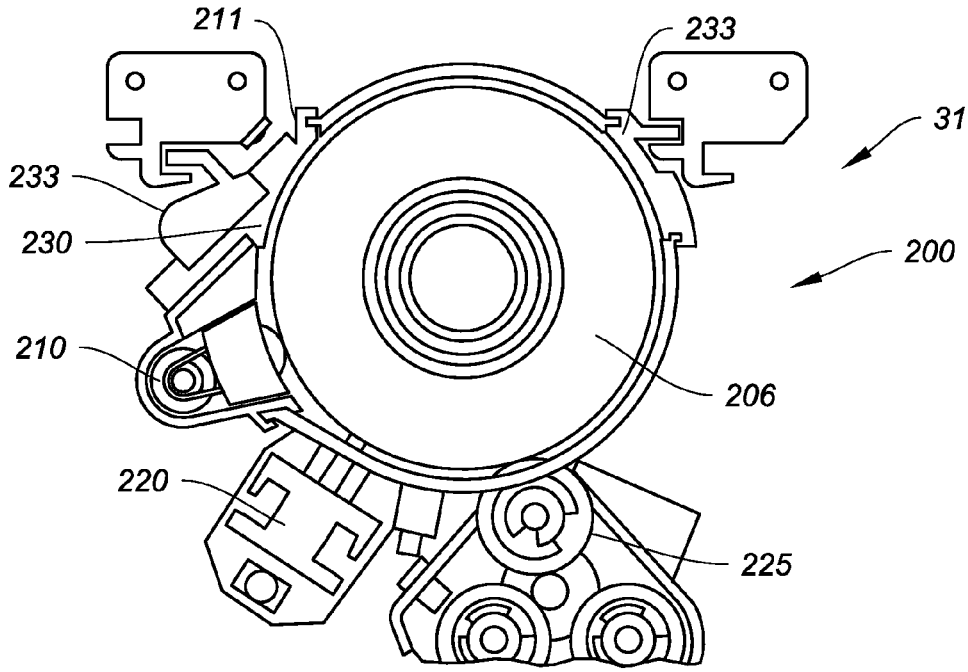
FIG. 2 is a cross-section of an electrophotographic print module cartridge with interface hardware.

Within the imaging module 31, periodic replacement of critical components is necessary to ensure proper function. It may be desired to cluster multiple components to enable simultaneous replacement. Referring to FIG. 2, shown with a change in form, is one such cluster, referred to as a replacement cartridge 200 within imaging module 31 consisting of a photoreceptive member 111, cleaning unit 230, and charging subsystem 210. These components are assembled into a cartridge and held in place with a plastic housing 233.

Figure 3:
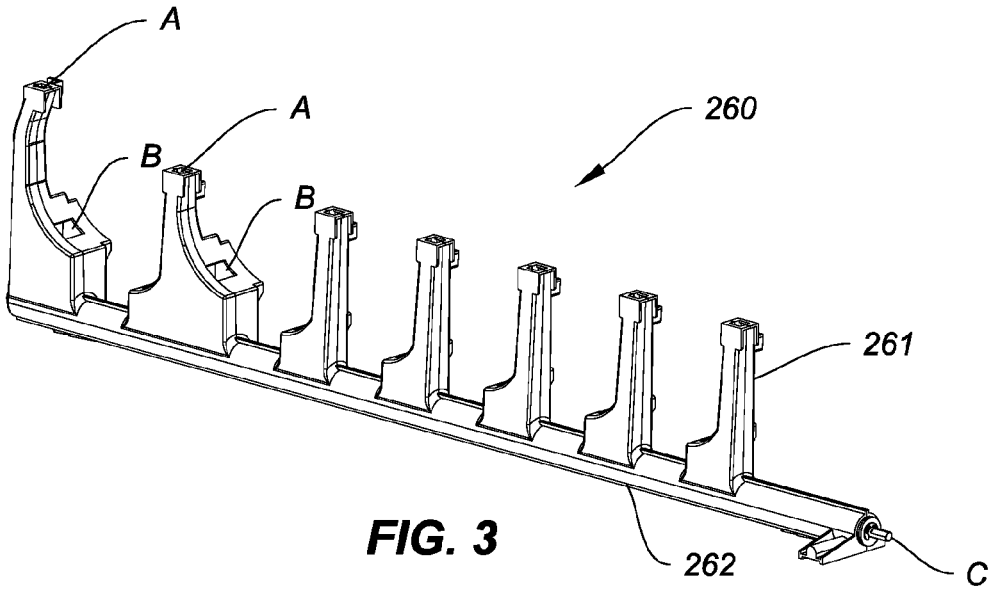
FIG. 3 is a waste transport device.

Referring now to FIG. 3 a waste transport device 260 is shown. The waste transport device consists of collection tube 261 and transport tube 262. Residual toner waste from cleaning unit 230 and toning unit 225 leave those devices and drop into the waste transport device at points A and B. The waste transport device 260 collects and combines the residual waste toner into a common waste stream which exits the waste transport device 260 at point C.

Figure 4:
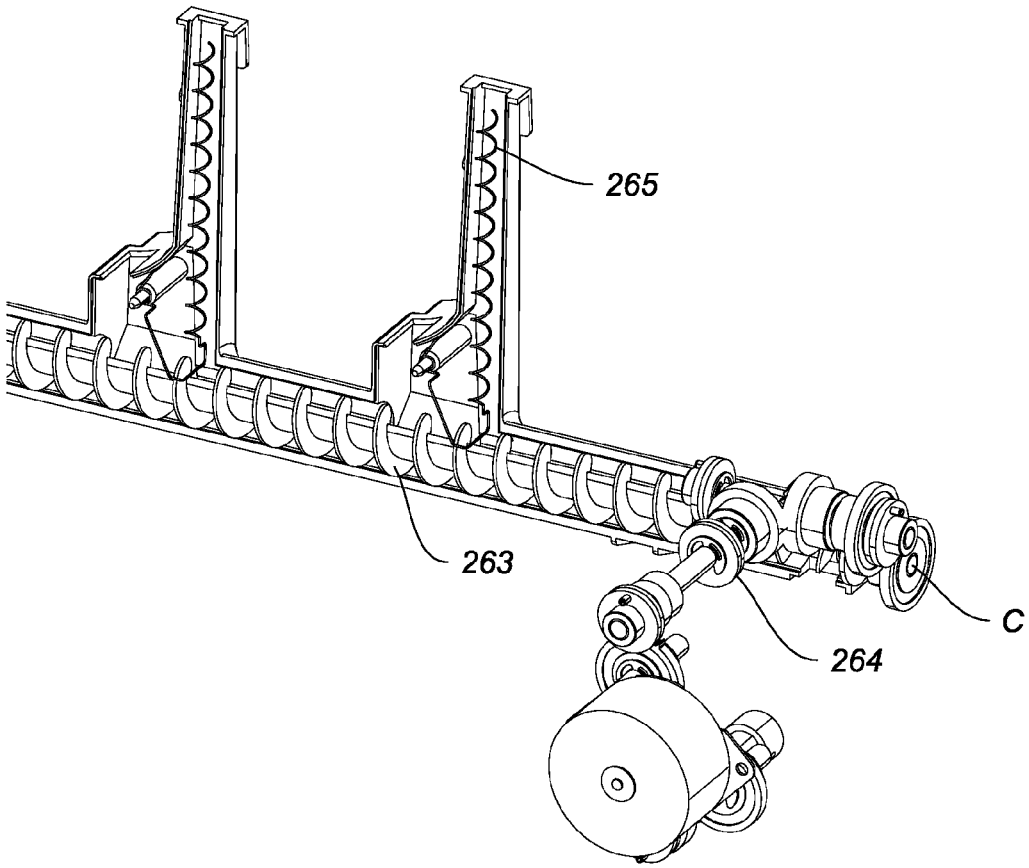
FIG. 4 is a waste transport device with internal detail.

Referring now to FIG. 4, a screw auger 263 within the transport tube 262 is turned with a drive device 264. Also shown is an anti-clog spring 265. The drive device 264 may take many forms, either through direct coupling, or with a belt drive or gear drive arrangement. The drive turns the screw auger 263 and transports the residual toner waste to a convenient collection point C. The screw auger 263 may or may not enter a waste collection bottle at point C. At interface points the toner drops with the aid of gravity from cleaning unit 230 and toning unit 225. These drop points are critical locations where careful management is required to prevent toner accumulation and clogging.

Figure 5:
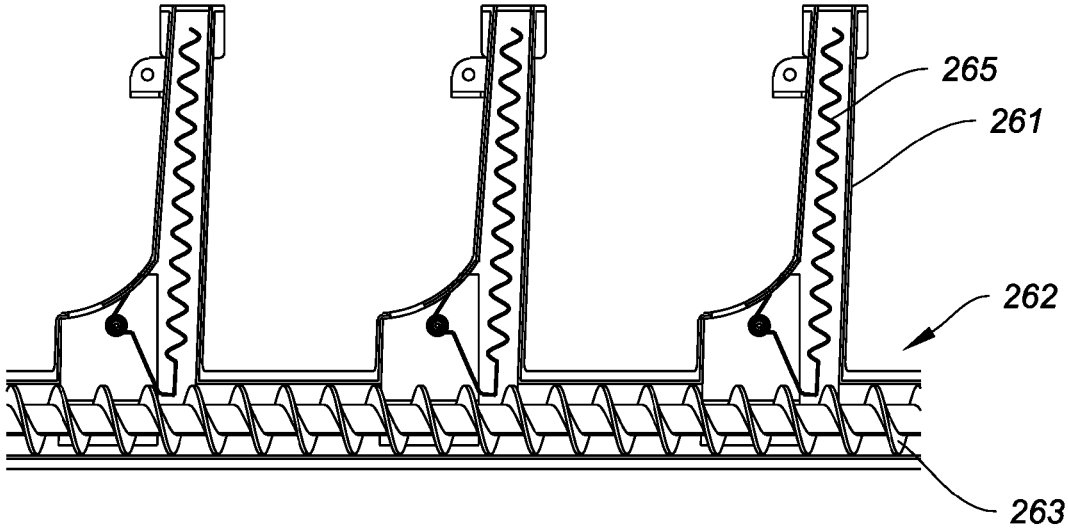
FIG. 5 is a waste transport device clogging prevention device.

Referring now to FIG. 5 is shown an anti-clog spring 265 is shown having a first end free in the collection tube 261 and a second end fixed within the transport tube 262 of a waste transport device 260. An elbow rides on the screw auger 263 such that as the auger turns the spring oscillates up and down the collection tube 261. Movement of the anti-clog spring agitates toner in the tube preventing a clog. Shown are three positions of continuous motion. The anti-clog spring 265 sliding up the collection tube 261 has diameter close to the diameter of the collection tube 261 so that toner accumulation is prevented. The diameter may be small or large so as to scavenge as much residual as desired. The elbow may also ride on the shaft of the screw auger. The anti-clog spring 265 may or may not enter the cleaning unit 230 and toning unit 225. If the anti-clog spring 265 enters the device, a means of timing the oscillating must be included so as to prevent damage to the anti-clog spring. This may be done through positional control of the auger drive.

Figure 6:
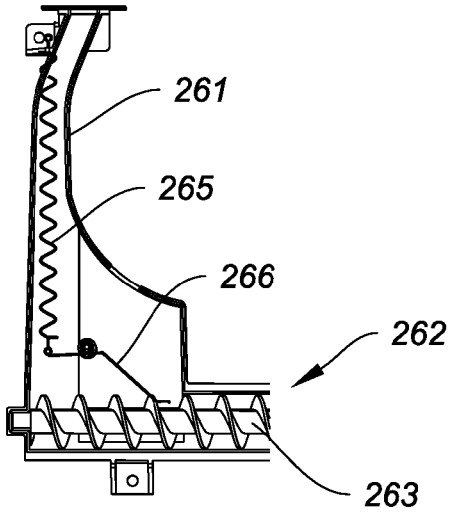
FIG. 6 is a waste transport device clogging prevention device.

Referring now to FIG. 6 an anti-clog spring is shown having a first end fixed in the collection tube 261 and a second end fixed within a transport tube 262 of the waste transport device 260. An elbow rides on the auger such that as the auger turns the spring oscillates up and down the collection tube. The spring sliding up the collection tube has diameter close to the diameter of the collection tube 261 so that toner accumulation is prevented. The diameter may be small or large so as to scavenge as much residual waste toner as desired. The elbow may also ride on the shaft of the auger. This arrangement with attachment at first end enables the spring position to be controllable around bends in collection tube 261, which typically accumulate residual waste toner and are of primary concern. Further the anti-clog spring may be broken into two sections, 265 and 266 in order to adjust the force of each section to enable the desired behavior.

The invention has been described in detail with particular reference to certain preferred embodiments thereof, but it will be understood that variations and modifications can be effected within the scope of the invention.

PARTS LIST

31 imaging module
111 photoreceptive member
200 replacement cartridge
206 photoreceptor
210 charging subsystem
211 meter
212 meter
213 grid
220 writer
225 toning unit
226 element
227 element
230 cleaning unit
233 plastic housing
260 waste transport device
261 collection tube
262 transport tube
263 screw auger
264 drive device
265 anti-clog spring
266 anti-clog spring

The invention claimed is:

1. A system for collecting waste toner or developer in an electrophotographic apparatus comprising:

a waste collection tube for collecting waste toner or developer from an electrophotographic module;

an auger for transporting waste toner or developer from the collection tube through a transport tube to a waste container;

a spring having a first end in the collection tube and a second end fixed within the transport tube of the auger;

wherein an elbow of the spring rides on the auger; and wherein motion of the auger causes the spring to oscillate in the collection tube.

2. The system of claim 1 wherein the first end of the spring is fixed to the collection tube.

3. The system of claim 2 wherein the spring is comprised of multiple parts.

4. The system of claim 1 wherein an angle of the elbow allows the elbow to contact a shaft of the auger during a complete rotation of the auger.

5. The system of claim 1 wherein the auger enters the waste container.

* * * * *